US011060392B2

(12) United States Patent
Picon

(10) Patent No.: US 11,060,392 B2
(45) Date of Patent: Jul. 13, 2021

(54) WIRELESS LOAD POSITION SENSOR

(71) Applicant: Eduardo N. Picon, Abu Dhabi (AE)

(72) Inventor: Eduardo N. Picon, Abu Dhabi (AE)

(73) Assignee: Control & Applications Digital Oil Field Solutions LLC, Abu Dhabi (AE)

( * ) Notice: Subject to any disclaimer, the term of this patent is extended or adjusted under 35 U.S.C. 154(b) by 72 days.

(21) Appl. No.: 16/203,608

(22) Filed: Nov. 29, 2018

(65) Prior Publication Data

US 2020/0123892 A1 Apr. 23, 2020

Related U.S. Application Data

(60) Provisional application No. 62/748,334, filed on Oct. 19, 2018.

(51) Int. Cl.
*E21B 43/12* (2006.01)
*E21B 47/009* (2012.01)

(52) U.S. Cl.
CPC ..... *E21B 47/009* (2020.05); *E21B 43/127* (2013.01)

(58) Field of Classification Search
CPC ..... E21B 47/009; E21B 43/127
See application file for complete search history.

(56) References Cited

U.S. PATENT DOCUMENTS

| | | | | |
|---|---|---|---|---|
| 4,561,299 | A | 12/1985 | Orlando et al. | |
| 4,662,209 | A | 5/1987 | Brown | |
| 5,281,100 | A * | 1/1994 | Diederich | E21B 43/127 417/18 |
| 5,589,633 | A * | 12/1996 | McCoy | E21B 47/009 417/63 |
| 7,212,923 | B2 | 5/2007 | Gibbs et al. | |
| 2006/0149476 | A1* | 7/2006 | Gibbs | E21B 47/009 702/6 |
| 2009/0055029 | A1 | 2/2009 | Roberson et al. | |
| 2016/0138949 | A1* | 5/2016 | Zhao | E21B 47/009 73/781 |
| 2020/0263531 | A1* | 8/2020 | Fyfe | H04Q 9/00 |

OTHER PUBLICATIONS

Schlumberger Oilfield Glossary—Drillpipe—Accessed Sep. 9, 2020; https://www.glossary.oilfield.slb.com/Terms/d/drillpipe.aspx (Year: 2020).*

Schlumberger Oilfield Glossary—Drill string—Accessed Sep. 9, 2020; https://www.glossary.oilfield.slb.com/Terms/d/drill_string.aspx (Year: 2020).*

* cited by examiner

*Primary Examiner* — David Carroll
(74) *Attorney, Agent, or Firm* — G. Michael Roebuck, PC

(57) ABSTRACT

A system and method for wireless load position sensor is disclosed.

10 Claims, 4 Drawing Sheets

WIRELESS LOAD POSITION SENSOR

CROSS REFERENCE TO RELATED PATENT APPLICATIONS

This patent application claims priority from U.S. Provisional Patent Application Ser. No. 62/748,334 filed on Oct. 19, 2018 by Eduardo N. Picon entitled "A SYSTEM AND METHOD FOR OBTAINING ACCURATE DYNAMOMETRIC CARDS FOR A RECIPROCATING PUMPING SYSTEM" which is hereby incorporated by reference herein in its entirety.

BACKGROUND OF THE INVENTION

In most oil wells, the pumping is carried out by use of a reciprocating downhole pump that is accomplished by a pumping rod which extends from the pump to the earth's surface where it is connected to a reciprocating walking beam. The walking beam is provided with a counter balance weight to offset the weight of the pumping rod, the pump and the fluid column. There are many variable factors involved in the operation for artificial lift of this type. Several types of instrumentation have been developed to monitor the pumping operation and measure the parameters of such operation. Once such measurements have been made, it is often possible to adjust and optimizations to improve the pumping efficiency of the well.

FIELD OF THE INVENTION

The present invention pertains, in general, to instrumentation for oil field equipment, specifically to a wireless load position sensor.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF AN ILLUSTRATIVE EMBODIMENT OF THE INVENTION

Figure 1A:
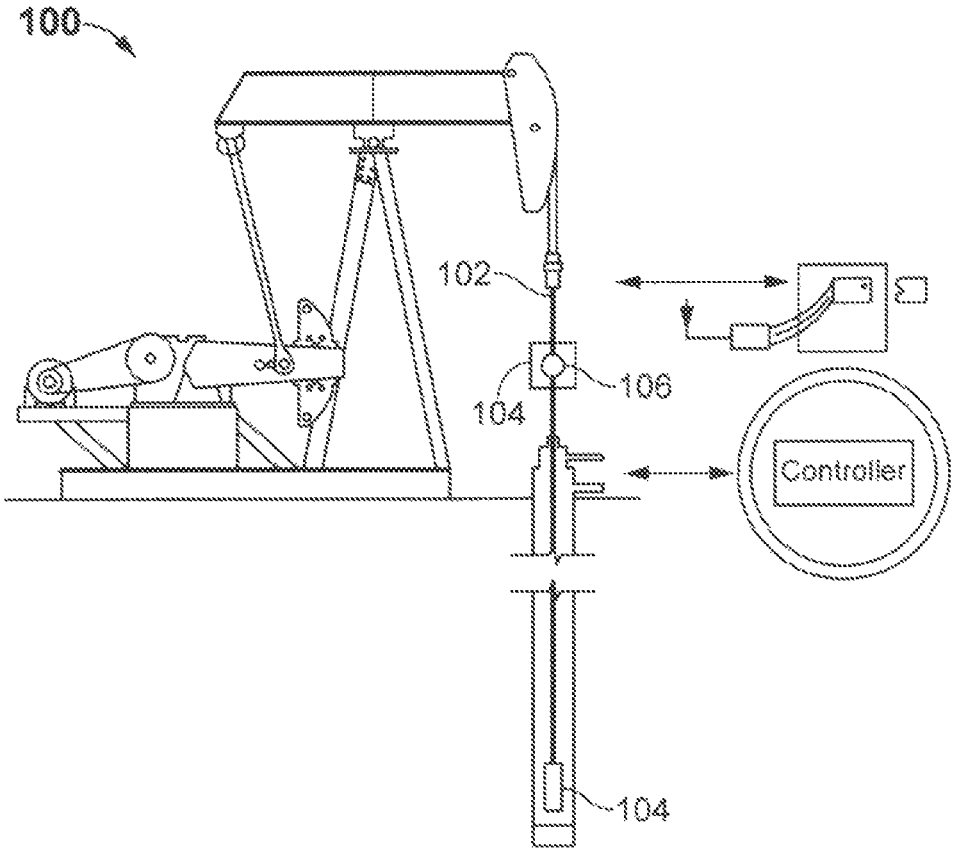
FIG. 1A is a perspective view of a reciprocating pumping system which raises and lowers a pumping rod connected to a downhole pump in a cyclical motion to lift fluid from within a borehole in the earth to the surface. An accelerometer is mounted on the pumping rod, also referred to herein as a polished rod, and electronic equipment is provided for processing a signal from the accelerometer to indicate load and rod position.

For some measurements, it is desirable to ascertain the load and position of a pumping rod in the stroke of the pumping operation. Commonly load values are obtained measuring directly with a load cell. Position measurements have heretofore been made in several ways, direct and indirect methods. As direct method, most use a mechanical sensor, a spring-loaded rotating potentiometer connected to the rod or beam by a string or cable so that the potentiometer rotates with the up and down motion of the pumping rod (sucker rod) or walking beam. Another direct method, is a solid-state sensor, using a clinometer mounted on walking beam that measures the walking beam angle and traduced by a single calculation as displacement length of polished rod. An apparatus for measuring the position of a sucker-rod is described in U.S. Pat. No. 4,561,299 entitled "Apparatus for Detecting Changes in Inclination or Acceleration". Another use of accelerometers as direct measure of rod position is described in U.S. Pat. No. 5,589,633 entitled "Method and Apparatus for Measuring Pumping Rod Position and Other Aspects of a Pumping System by Use of an Accelerometer", and an apparatus which utilizes an accelerometer to measure course length in a wellbore is described in U.S. Pat. No. 4,662,209 entitled "Course Length Measurement". This device, however, does not measure pumping rod position.

Indirect methods are used due to low cost, not mechanical devices, and substantially maintenane-free operation. The predominant method is to use a switch (mechanical or solid-state, normally Hall Effect) that permits detection of a crank rotation (cycle duration, one crank rotation=one pumping cycle). The cycle duration is divided as equal intervals of time and transduced as equal intervals of displacement, using trigonometric calculations on pumping unit dimensions, cycle duration is proportional to the position of the rod.

All these mentioned devices are hardwired to external electronic equipment and depend on it to obtain a dynamometric card. Today, there exists a need of wireless device that permits obtain a complete dynamometric card solved on site without dependence on external devices allowing distributed processing, accurate, inexpensive, convenient and not affected by wear and exposure. A sucker Rod Pumping unit is applied in oil extraction, a reciprocating rod string connected to a downhole pump. The operation and performance of such pumps can be evaluated and optimized through a kinetic energy analysis and applying mathematical models from surface measurements. The industry has used a pump-off controller to evaluate such performance.

It is possible to perform a kinetic analysis of a lift system, and to substantially optimize an extractive process, and help to prevent possible damages through a pump-off controller during the extractive process applying mathematics models on values measured in surface on the well. For this, is necessary to measure the loads supported by the polished rod and its position into pumping cycle. Obtained values, are represented by a dynamometric card.

In order to measure the loads, a load cell is installed between a polished rod and rod clamp to measure the true loads that are being supported by the polished rod coming from rod string, downhole pump, frictions and other dynamics effect that are present during a pumping cycle. As main element to determine the polished rod position, an accelerometer is used, mounted in conjunction with load cell, to determine by an indirect process, a position of a polished rod, measuring the accelerations produced in the polished rod during its ascent and descent motion. All measured accelerations are integrated constantly forming a sinusoidal curve that permits determination of duration of each complete pumping cycle and half-cycles (ascending and descending).

A time interval is determined for a complete cycle and each half-cycle, applying trigonometric algorithms can be calculated position of polished rod in any instant of cycle considering necessary adjust in case of belts slippage. Together with position calculations, loads are acquired and digitalized in real time into the same apparatus allowing an illustrative embodiment of the invention to generate constant dynamometric cards to be transmitted via a short-range radio, on-demand (full card) or in real time (point to point), to external pump-off controller where kinetic analysis and process control is performed.

The present invention, in one particular embodiment, is directed to a method and apparatus for obtain out of process controller a dynamometer card, formed for corresponding values of loads and positions of a rod used in a reciprocating pumping system wherein the rod extends downward into a borehole in the earth and is joined to a downhole pump which lifts fluid within the borehole to the surface of the earth.

A load cell, an accelerometer, and necessary electronic to processing, and a device for data transmission are mounted on the pumping system to move in conjunction with the rod. As output, a complete dynamometric card is generated when each pumping cycle is finished and transmitted on-demand or real time to controller where complete analysis of lift system and process control is performed.

In a particular illustrative embodiment of the invention, independent cards acquisition and wireless transmission of values to an external controller. In a particular illustrative embodiment of the invention, an apparatus is provided including but not limited to a circuit count with a low-voltage ARM microprocessor@ 140 MHz (210 MMIPS), a three axis+/−16 g accelerometer, a GPIA ADC, and a 2.4 GHz short-range radiocapability of 2 Mbps, supplied by a 9V battery. Design of circuit is using low-power and low-consume components substantially optimizing high duration of the 9V battery.

In a particular illustrative embodiment of the invention, the system and method are configured to obtain correct and accurate values which can be stored and retransmitted or transmitted as the values are processed. The configuration of a circuit is performed locally or transmitted from controller through a proprietary protocol. Values configured are: Pumping unit type, pumping unit API dimensions, pumping unit stroke length, maximum load cell weight scale, load cell polarity, load cell gain (mV/V), ADC programmed gain, load cell offset, and acquisition mode (On-Demand or Real Time), accelerometer values and time.

As mentioned, a dynamometric card is formed by load and position values (pair of points), for this, apparatus firmware uses a three-dimension array to store values of: position scaled value (calculated values), load scaled value (acquired), and time for each pair of point when corresponding load value must be acquired. At same time, when each pumping cycle is completed, pumping speed (strokes per minute), peak and minimum measured loads are registered.

An accelerometer used in a particular embodiment of the invention. The accelerometer does not need to be calibrated previously and signal providing from it are digital values corresponding to current linear gravity acceleration measured, therefore do not need to be converted or treated before being processed.

The linear acceleration values acquired by accelerometer sensors are integrated substantially on a continuous basis when the system and method are in operation. The integral of the accelerometer values indicates pumping rod position in real time. This constant integration of the acceleration value, determines a sinusoidal curve into each pumping cycle period, therefore, maximum negative values correspond to bottom of stroke and maximum positive values correspond to top of stroke. Each time that a bottom of stroke is detected, indicated by a maximum positive accelerometer value, a timer is started to compute duration of different stages of the pumping cycle. The top of a pumping cycle is determined by a maximum negative accelerometer value. Duration of a complete cycle (bottom to bottom) and each half-cycle (bottom to top, top to bottom) is calculated. Once the duration of a complete cycle is known, this cycle time is divided into 200 intervals (100 intervals for an ascending rod half cycle, 100 for descending rod half cycle). Each time interval theoretically corresponds to one proportional interval of rotation. A full crank rotation (360°) is divided by the number of intervals (200) can be obtained theoretical displacement of crank in each interval, in this case, each 1.8° (360°|200=1.8°). Knowing the dimensions of the pumping unit, the position of the polished rod is calculated for each of these rotation intervals.

The pumping unit is driven by a motor mechanically coupled through belts to the pump. This mechanical motion belt transmission couple can suffer variations due to belts slippage. Thus, if the position calculation is based only on equal time intervals into a complete crank rotation, the calculated positions would not be entirely correct, due to possible belt slippage, therefore, it is necessary to account for the possibility of belts slippage. For this reason, the duration of each half-cycle is timed and each time interval and polished rod position for each half-cycle is calculated independently dividing the duration of each half-cycle by 100. Finished calculations, each polished rod position values and each angular interval is stored into memory array. Pumping speed is calculated and stored.

If full cycle or any of half-cycles time duration changes (pumping speed), the process of position calculation is re-performed.

As this used method for position calculation is indirect, operational anomalies as rod vibrations or fluid pounding are not detected disturbances. This effects normally are not desired because can interfere in the card form, therefore, this method of acquisition is advantageous for the elimination of these types of disturbances. These measurements are transmitted to an RTU to enable more accurate correction and adjustment of the pumping cycle in real time.

Load measurement is performed by a load cell (using analog signals from the load cell). This analog load cell signal is filtered, amplified and digitalized before being stored and transmitted later or transmit as the analog load cell signals are digitized. In a particular embodiment of the invention, an integrated circuit board is provided that uses PGIA (Programmable Gain Instrumentation Amplifier) Delta-Sigma Analog-to-Digital converter. This integrated circuit is 24-bit ADC optimized for measuring low-level unipolar or bipolar signals, very low-noise, chopper-stabilized instrumentation amplifier with selectable gains and digital filter.

Once PGIA ADC is configured for be used with installed load cell, and time intervals and positions vector has been calculated, loads values can be acquired and retransmitted in real time. A timer and a pointer are used to controls load acquisition. If a new pumping cycle is detected (bottom stroke); pointer is reset to 0, and timer is restarted. When elapsed time is equal to current pointer pre-set time, a load value is acquired and stored in an array in computer readable memory according to pointer index, and thereafter, the pointer is incremented. In case that acquisition mode was configured as "Real time", Load and Position values are transmitted to controller each time that load is acquired, case else, that acquisition mode is "On-demand", when a pumping cycle is finished the full card obtained is move to a separate buffer (bi-dimensional array of load and position) and is ready to be transmitted to controller when is required.

During acquisition process, when the system and method are being used, the following card values are acquired, process, stored and transmitted:

Full dynamometric
card of lastcycle
Live load and position values
Battery voltage
High belt slippage alarm
Full dynamometric card of last cycle
Live load and position values
Pumping state (running or stopped) Peak and minimum load in last cycle
Pumping speed (SPM)
Battery voltage
Belt slippage percentage Low battery alarm
High belt slippage alarm
Counterweight Imbalance alarm The system and method provide a proprietary communication protocol that enables bi-directional data transfer between the system and method and a local controller.

Figure 1B:
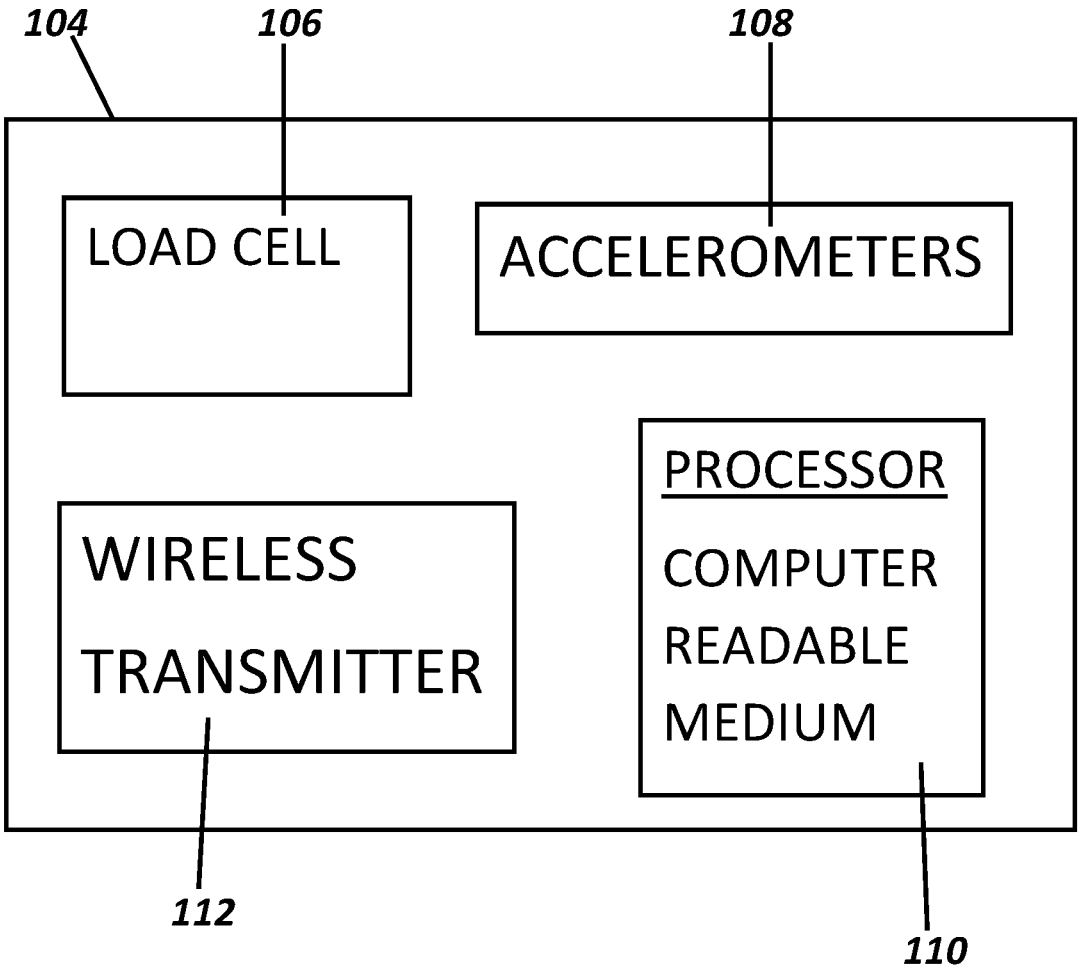
FIG. 1B is plan view of a block diagram of an electronics package in a particular illustrative embodiment of the invention.

Turning now to FIG. 1A, FIG. 1A is a perspective view of a reciprocating pumping system 100 which raises and lowers a pumping rod 102 (also referred to herein as a polished rod) connected to a downhole pump 104 in a reciprocating cyclical motion to lift fluid from within a borehole in the earth to the earth's surface. As shown in FIG. 1B, an electronic enclosure 104 containing a load cell 106, accelerometer 108, processor 110, wireless transmitter 112 and computer readable memory is mounted on the polished rod, and electronic equipment is provided for processing the signal from the accelerometer to indicate load and rod position.

The electronic enclosure containing the load cell is installed between a polished rod and rod clamp to measure the actual loads that are being supported by the polished rod coming from rod string, the downhole pump, including friction and other mechanical dynamics effects that are present during a pumping cycle. As one of the elements provided to determine the polished rod position, an accelerometer is provided, mounted in in the electronics enclosure with the load cell, to determine by an indirect process, a position of the polished rod at regular time intervals and positions of the polished rod during a pumping cycle. The processor 100 communicates with the accelerometers that measure the accelerations produced in the polished rod during its ascent and descent motions during the pumping cycle. All measured accelerations are integrated constantly forming a sinusoidal curve that permits determination of duration of each complete pumping cycle and half-cycles (ascending and descending). It is well known that the position of an accelerometer and the equipment to which the accelerometer is attached is determined by a summation of the integral of the acceleration measurements which is used to determine the position of the accelerometer along its path during ascent or descent.

Figure 2:
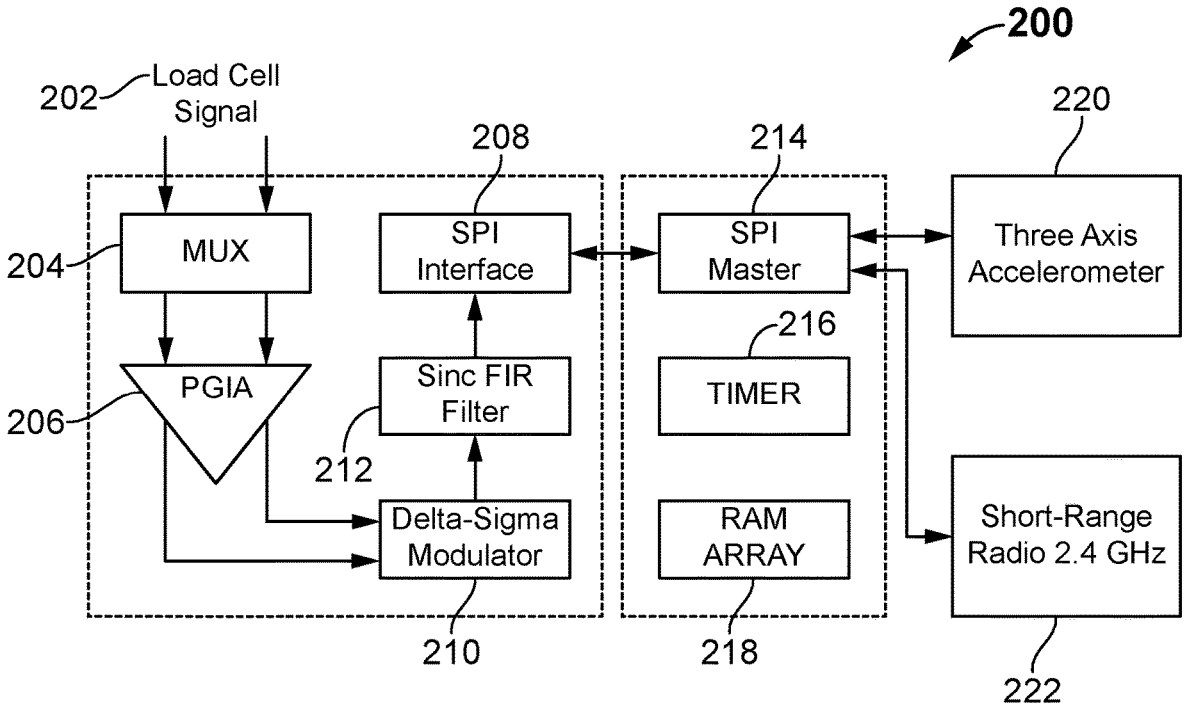
FIG. 2 is a schematic circuit illustration of used electronic circuit in a particular illustrative embodiment of the invention.

Turning now to FIG. 2, FIG. 2 is a schematic circuit illustration of an electronic circuit 200 provided in a particular illustrative embodiment of the invention. As shown in FIG. 2, load cell signal 202 measure the load and generates a load cell signal and inputs the signal to a MUX 204 which multiplexes the load cell signal and delivers these signals to a PGIA 206. The PGIA delivers the signal 202 to a Delta-Sigma Modulator 210. The Delta-Sigma Modulator processes the signals and delivers the processed signal to a Sinc Fir Filter 212. The Sinc Fir Filter filters the processed signal and delivers the filtered signal to an SPI interface 208. The SPI interface delivers the processed signal.

A three-axis accelerometer 220 measures accelerations in three directions, x, y and z and generates accelerometer x, y and z signals 201 based on these measurements. The accelerometer signals are sent to the SPI master processor. A timer 216 generates a time signal that is supplied to the SPI master processor and is used to correlate the accelerometer measurements to determine pump cycle positions as described herein. The pump cycle positions are correlated with the load cell measurement to determine load at different positions in the pump cycle. The SPI includes but is not limited to the processor and the computer readable medium, wherein the computer readable medium contains an embedded computer program comprising executable computer instructions that the computer program uses to process the load cell signals and accelerometer signals as described herein.

Figure 3:
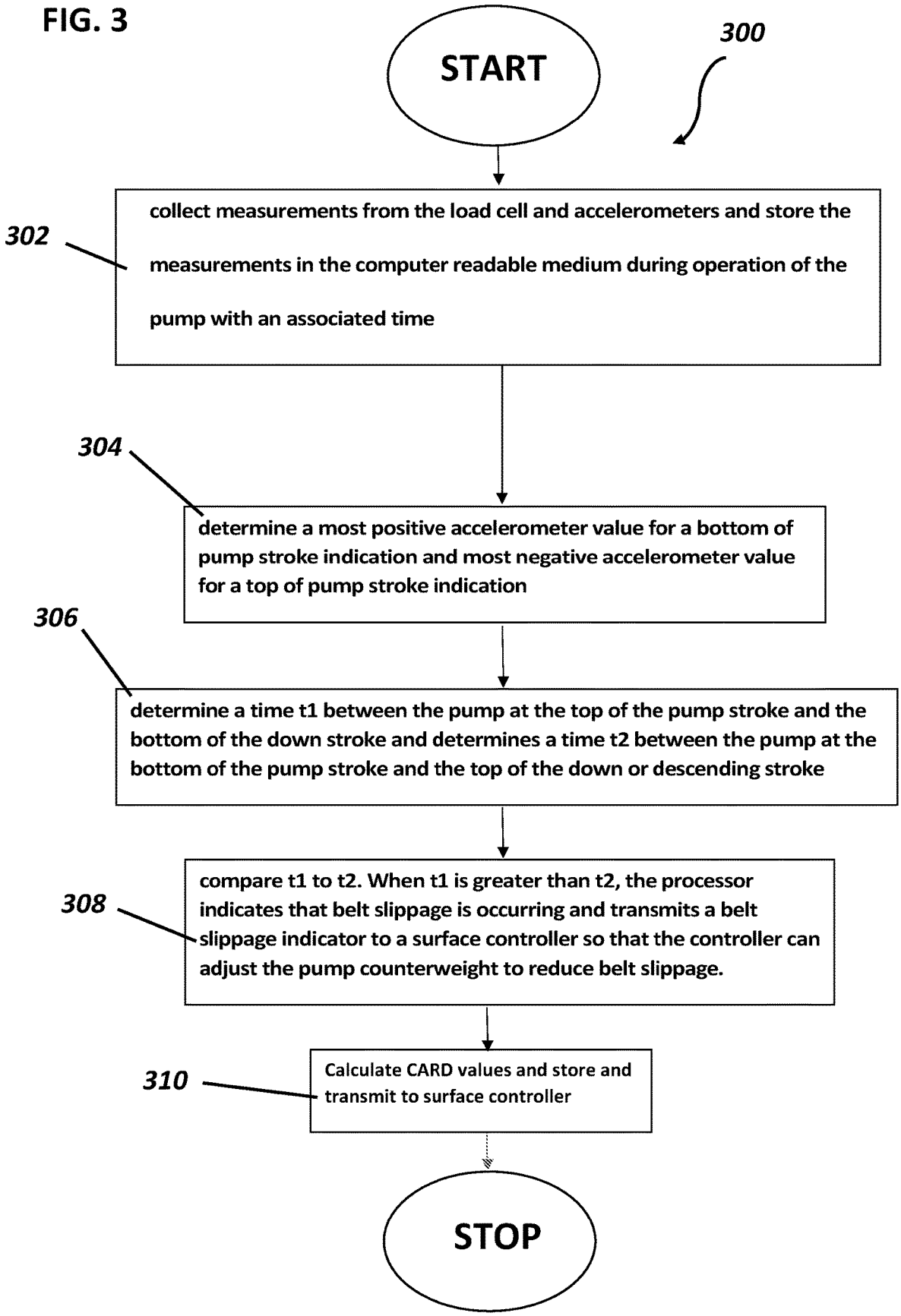
FIG. 3 is a flow diagram indicating the processing operations carried out in a particular illustrative embodiment of the invention.

Turning now to FIG. 3, FIG. 3 is a flow diagram 300 indicating the processing operations carried out by an illustrative embodiment of the invention where a system and execute a computer program. The computer program comprises computer executable instructions stored in computer readable medium that when executed by a processor perform the method described herein. As shown in FIG. 3, in a particular illustrative embodiment, the processor, using the computer program first collects measurements from the load cell and accelerometers and stores the measurements in the computer readable medium 302 during operation of the pump. The processor stores an associated time stamp along with the load cell and accelerometer values for each of the load cell and accelerometer values.

The processor then determines a most positive accelerometer value for a bottom of pump stroke indication. The processor then determines a most negative accelerometer value for a top of pump stroke indication 304. The processor then determines a time t1 between the pump at the top of the pump stroke and the bottom of the down stroke. This is the first half of a pump cycle, the down stroke. The processor then determines a time t2 between the pump at the bottom of the pump stroke and the top of the down or descending stroke. This is the second half of a pump cycle, the up or ascending stroke 306. The processor compares t1 to t2. When t1 is greater than t2, the processor indicates that belt slippage is occurring and transmits a belt slippage indicator to a surface controller so that the controller can adjust the pump counterweight to reduce belt slippage 308. Further processing is described above. The CARD values are calculated, stored and transmitted to a surface controller 310. The accelerometers are advantage over other position indicators in that the accelerometers do not have to calibrated to zero at a particular position.

In a particular illustrative embodiment of the invention, an apparatus is disclosed, including but not limited to a walking beam attached to a reciprocating down hole pump, wherein the down hole pump is deployed in the oil well; a belt attached to the walking beam wherein the belt is attached to the walking beam to move the walking beam up and down; a pumping rod operationally connected to the walking beam; an electronic enclosure containing a load cell, an accelerometer, a first processor, a wireless transmitter and a computer readable memory containing an embedded computer program executed by the processor, wherein the electronic enclosure is mounted on a pumping rod deployed on a drill string; and electronic equipment is provided for processing the signal from the accelerometer to indicate a load and a pumping rod position.

In another illustrative embodiment of the invention, the electronic equipment includes but is not limited to a timer that generates a time signal that is supplied to a second processor and is used to correlate the accelerometer measurements to determine pump cycle positions, wherein the pump cycle positions are correlated with the load cell measurements to determine a load at different positions in the pump cycle.

In another illustrative embodiment of the invention, the computer program collects measurements from the load cell and accelerometers and stores the measurements in the computer readable medium during operation of the pump and stores an associated time stamp along with the load cell and accelerometer values for each of the load cell and accelerometer values.

In another illustrative embodiment of the invention, the computer program executed by the processor then determines a most positive accelerometer value to determine a bottom of pump stroke indication; the computer program then determines a most negative accelerometer value to determine a top of pump stroke indication; and the computer program then determines a time t1 between the pump at the top of the pump stroke and the bottom of the down stroke.

In another illustrative embodiment of the invention, the first half of a pump cycle is a down stroke, the system further comprising the computer program then determines a time t2 between the pump at the bottom of the pump stroke and the top of the down or descending stroke, wherein this is the second half of a pump cycle, the up or ascending stroke; the computer program compares t1 to t2; and wherein when t1 is greater than t2, the computer program indicates that belt slippage is occurring and transmits a belt slippage indicator to a surface controller so that the controller can adjust the pump counterweight to reduce belt slippage.

In another particular illustrative embodiment of the invention, a system is disclosed, wherein the system includes but is not limited to an oil well; a walking beam attached to a reciprocating down hole pump, wherein the down hole pump is deployed in the oil well; a belt attached to the walking beam wherein the belt is attached to the walking beam to move the walking beam up and down; a pumping rod operationally connected to the walking beam; an electronic enclosure containing a load cell, an accelerometer, a first processor, a wireless transmitter and a computer readable memory containing an embedded computer program executed by the processor, wherein the electronic enclosure is mounted on a pumping rod deployed on a drill string; and electronic equipment is provided for processing the signal from the accelerometer to indicate a load and a pumping rod position.

In another illustrative embodiment of the invention, in the system the electronic equipment includes but is not limited to a timer that generates a time signal that is supplied to a second processor and is used to correlate the accelerometer measurements to determine pump cycle positions, wherein the pump cycle positions are correlated with the load cell measurements to determine a load at different positions in the pump cycle.

In another illustrative embodiment of the invention, in the system, the computer program collects measurements from the load cell and accelerometers and stores the measurements in the computer readable medium during operation of the pump and stores an associated time stamp along with the load cell and accelerometer values for each of the load cell and accelerometer values.

In another illustrative embodiment of the invention, in the system, the computer program executed by the processor then determines a most positive accelerometer value to determine a bottom of pump stroke indication; the computer program then determines a most negative accelerometer value to determine a top of pump stroke indication; and the computer program then determines a time t1 between the pump at the top of the pump stroke and the bottom of the down stroke.

In another illustrative embodiment of the invention, in the system, the first half of a pump cycle is a down stroke, the system further comprising the computer program then determines a time t2 between the pump at the bottom of the pump stroke and the top of the down or descending stroke, wherein this is the second half of a pump cycle, the up or ascending stroke; the computer program compares t1 to t2; and wherein when t1 is greater than t2, the computer program indicates that belt slippage is occurring and transmits a belt slippage indicator to a surface controller so that the controller can adjust the pump counterweight to reduce belt slippage.

In another illustrative embodiment of the invention, in a method is disclosed, the method including but not limited to generating on a processor, a time signal; correlating on the processor the accelerometer measurements to determine pump cycle positions; and correlating wherein the pump cycle positions with the load cell measurements to determine a load at different positions in the pump cycle, wherein a walking beam is attached to a reciprocating down hole pump, deployed in the oil well, a belt attached to the walking beam wherein the belt is attached to the walking beam to move the walking beam up and down, a pumping rod operationally connected to the walking beam, an electronic enclosure containing a load cell, an accelerometer, the processor, a wireless transmitter and a computer readable memory containing an embedded computer program executed by the processor, wherein the electronic enclosure is mounted on a pumping rod deployed on a drill string and electronic equipment is provided for processing the signal from the accelerometer to indicate a load and a pumping rod position.

In another particular illustrative embodiment of the invention, in the method, the electronic equipment comprises a timer, the method further including but not limited to correlating the accelerometer measurements to determine pump cycle positions, wherein the pump cycle positions are correlated with the load cell measurements to determine a load at different positions in the pump cycle.

In another particular illustrative embodiment of the invention, the method further includes but is not limited to collecting measurements on the processor from the load cell and accelerometers; storing the measurements in the computer readable medium during operation of the pump; and storing an associated time stamp along with the load cell and accelerometer values for each of the load cell and accelerometer values in the computer readable medium.

In another particular illustrative embodiment of the invention, the method further includes but is not limited to determining on the processor a most positive accelerometer value to determine a bottom of pump stroke indication; determining a most negative accelerometer value to determine a top of pump stroke indication; and determining on the processor a time t1 between the pump at the top of the pump stroke and the bottom of the down stroke.

In another particular illustrative embodiment of the invention, in the method the first half of a pump cycle is a down stroke, the method further determining a time t2 between the pump at the bottom of the pump stroke and the top of the down or descending stroke, wherein this is the second half of a pump cycle, the up or ascending stroke; comparing on the processor t1 to t2; and when t1 is greater than t2, the computer program indicates that belt slippage is occurring and transmits a belt slippage indicator to a surface controller so that the controller can adjust a pump counterweight to reduce belt slippage.

The present inventions can be realized in hardware, software, or a combination of hardware and software. In a specific embodiment, a system according to the present inventions can be realized in a centralized fashion in one computer system, or in a distributed fashion where different elements are spread across several interconnected computer systems. Any kind of computer system or other apparatus adapted for carrying out the methods and inventions described herein may be used for purposes of the present inventions. A typical combination of hardware and software could be a general-purpose computer system with a computer program that, when being loaded and executed, controls the computer system such that it carries out the methods and inventions described herein.

The figures herein include block diagram and flowchart illustrations of methods, apparatus(s) and computer program products according to various embodiments of the present inventions. It will be understood that each block in such figures, and combinations of these blocks, can be implemented by computer program instructions. These computer program instructions may be loaded onto a computer or other programmable data processing apparatus to produce a machine, such that the instructions which execute on the computer or other programmable data processing apparatus may be used to implement the functions specified in the block, blocks or flow charts. The flow chart is an example only and the steps shown in the flow chart need not be executed in the exact order shown on the flow chart. Moreover, some of the steps in the flow chart can be left out in performing the system and method of the present invention. These computer program instructions may also be stored in a computer-readable medium or memory that can direct a computer or other programmable data processing apparatus to function in a particular manner, such that the instructions stored in the computer-readable medium or memory produce an article of manufacture including instructions which may implement the function specified in the block, blocks or flow charts.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the block, blocks or flow chart. Those skilled in the art should readily appreciate that programs defining the functions of the present inventions can be delivered to a computer in many forms, including but not limited to: (a) information permanently stored on non-writable storage media (e.g., read only memory devices within a computer such as ROM or CD-ROM disks readable by a computer I/O attachment); (b) information alterably stored on writable storage media (e.g., floppy disks and hard drives); or (c) information conveyed to a computer through communication media for example using wireless, baseband signaling or broadband signaling techniques, including carrier wave signaling techniques, such as over computer or telephone networks via a modem, or via any of the networks known. A diagram is shown illustrating an example of a computer that may be used in connection with the present inventions. The computer may include at least one processor and at least one memory, each of which may be coupled to a local interface or bus. An operating system may be stored in the memory and executable by the processor. Any variety of software programs may also be stored in the memory and executable by the processor.

In a specific embodiment, examples of programs that may be stored in the memory and executable by the processor. A media player application may be stored in the memory and executable by the processor. Also stored in the memory may be various forms of data. The term "executable" as used herein means that a program file is of the type that may be run by the processor. In specific embodiments, examples of executable programs may include without limitation: a compiled program that can be translated into machine code in a format that can be loaded into a random access portion of the memory and run by the processor; source code that may be expressed in proper format such as object code that is capable of being loaded into a random access portion of the memory and executed by the processor; or source code that may be interpreted by another executable program to generate instructions in a random access portion of the memory to be executed by the processor.

An executable program may be stored in any portion or component of the memory including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components. The memory may include both volatile and nonvolatile memory and data storage components. Volatile components are those that do not retain data values upon loss of power. Nonvolatile components are those that retain data upon a loss of power. Thus, the memory may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components.

In addition, the RAM may comprise, for example, static random-access memory (SRAM), dynamic random-access memory (DRAM), or magnetic random-access memory (MRAM) and other such devices. The ROM may comprise, for example, a programmable read-only memory (PROM), an erasable programmable read-only memory (EPROM), an electrically erasable programmable read-only memory (EEPROM), or other like memory device. In a specific embodiment, the processor may represent multiple processors and/or multiple processor cores and the memory may represent multiple memories that operate in parallel processing circuits, respectively. In such a case, the local interface may be an appropriate network that facilitates communication between any two of the multiple processors, between any processor and any of the memories, or between any two of the memories. The local interface may comprise additional systems designed to coordinate this communication, including, for example, performing load balancing. The processor may be of electrical or of some other available construction.

Although the programs and other various systems, components and functionalities described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components. Such technologies are generally well known by those skilled in the art and, consequently, are not described in detail herein. The flowchart of FIG. 3 shows the functionality and operation of various specific embodiments of certain aspects of the present inventions. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s). Although the flowchart of FIG. 2 shows a specific order of execution, it is understood that the order of execution may differ from that which is depicted. For example, the order of execution of two or more blocks may be scrambled relative to the order shown. Also, two or more blocks shown in succession in FIG. 3 may be executed concurrently or with partial concurrence. Further, in some embodiments, one or more of the blocks shown in FIG. 3, may be skipped or omitted. In addition, any number of counters, state variables, warning semaphores, or messages might be added to the logical flow described herein, for purposes of enhanced utility, accounting, performance measurement, or providing troubleshooting aids. It is understood that all such variations are within the scope of the present inventions. Any logic or application described herein that comprises software or code can be embodied in any non-transitory computer-readable medium, such as computer-readable medium, for use by or in connection with an instruction execution system such as, for example, a processor in a computer system or other system. In this sense, the logic may comprise, for example, statements including instructions and declarations that can be fetched from the computer-readable medium and executed by the instruction execution system. In the context of the present inventions, a "computer-readable medium" may include any medium that may contain, store, or maintain the logic or application described herein for use by or in connection with the instruction execution system.

The computer-readable medium may comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random-access memory (RAM) including, for example, static random-access memory (SRAM) and dynamic random-access memory (DRAM), or magnetic random-access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device. The computer may further include a network interface coupled to the bus and in communication with a network. The network interface may be configured to allow data to be exchanged between computer and other devices attached to the network or any other network or between nodes of any computer system or the video system. In addition to the above description of the network, it may in various embodiments include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, the network interface may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol. The computer may also include an input/output interface coupled to the bus and also coupled to one or more input/output devices, such as a display, a touchscreen, a mouse or other cursor control device, and/or a keyboard. In certain specific embodiments, further examples of input/output devices may include one or more display terminals, keypads, touchpads, scanning devices, voice or optical recognition devices, or any other devices suitable for entering or accessing data by one or more computers. Multiple input/output devices may be present with respect to a computer or may be distributed on various nodes of computer system, the system and/or any of the viewing or other devices. In some embodiments, similar input/output devices may be separate from the computer and may interact with the compute or one or more nodes of computer system through a wired or wireless connection, such as through the network interface. It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. An apparatus comprising:

a walking beam attached to a reciprocating down hole pump deployed in the oil well;

a belt attached to the walking beam wherein the belt is attached to the walking beam to move the walking beam up and down;

a pumping rod operationally connected to the walking beam;

an electronic enclosure containing a load cell, an accelerometer, a wireless transmitter, wherein the electronic enclosure is mounted on a pumping rod attached to the down hole pump; and a processor in communication with the wireless transmitter;

a computer readable medium attached to the processor, wherein the computer readable medium contains instructions that are executed by the processor, the computer program comprising:

instructions to process accelerometer measurements from the accelerometer to indicate a belt slippage, a load on the pumping rod and a pumping rod position.

2. The apparatus of claim 1, further comprising:

a timer that generates a time signal for the signal from the accelerometer;

the computer program further comprising:

instructions to correlate the accelerometer measurements to determine pump cycle positions, wherein the pump cycle positions are correlated with the load cell measurements to determine a load at different positions in the pump cycle.

3. The apparatus of claim 2, the computer program further comprising:

instructions to collect measurements from the load cell and the accelerometer;

instructions to store the measurements from the load cell and the accelerometer in the computer readable medium during operation of the pump; and instructions to store an associated time stamp along with the load cell measurements and the accelerometer measurements for each of the load cell and accelerometer values.

4. The apparatus of claim 3, wherein the second computer program further comprising:

instructions to determine a most positive accelerometer value to determine a bottom of pump stroke indication;

instructions to determine a most negative accelerometer value to determine a top of pump stroke indication; and instructions to determine a time t1 between the pump at the top of a pump stroke and the bottom of a down stroke.

5. The apparatus of claim 4, wherein the first half of a pump cycle is a down stroke, the second computer program further comprising instructions to determine a time t2 between a pump at the bottom of the pump stroke and a top of the down or descending stroke, wherein this is the second half of a pump cycle, the up or ascending stroke;

instructions to the compare t1 to t2; and instructions to when t1 is greater than t2, transmit a belt slippage indicator to a surface controller so that the surface controller can adjust the pump counterweight to reduce belt slippage.

6. A method, the method comprising:

generating on a processor, a time signal;

correlating on the processor the time signal with accelerometer measurements to determine pump cycle positions wherein the pump cycle positions with the load cell measurements to determine a load at different positions in the pump cycle, wherein a walking beam is attached to a reciprocating down hole pump, a belt attached to the walking beam wherein the belt is attached to the walking beam to move the walking beam up and down, a pumping rod operationally connected to the walking beam, an electronic enclosure containing a load cell, an accelerometer, the processor, a wireless transmitter and a computer readable memory containing an embedded computer program executed by the processor, wherein the electronic enclosure is mounted on a pumping rod and processing the signal from the measurements from the accelerometer to indicate a belt slippage, a load and a pumping rod position.

7. The method of claim 6, wherein the electronic equipment comprises a timer, the method further comprising:

correlating the accelerometer measurements to determine pump cycle positions, wherein the pump cycle positions are correlated with the load cell measurements to determine a load at different positions in the pump cycle.

8. The method of claim 7, the method further comprising:

collecting measurements on the processor from the load cell and the accelerometer;

storing the measurements in the computer readable medium during operation of the pump; and storing an associated time stamp along with the load cell and accelerometer values for each of the load cell and accelerometer values in the computer readable medium.

9. The method of claim 8, the method further comprising:

determining on the processor a most positive accelerometer value to determine a bottom of pump stroke indication;

determining a most negative accelerometer value to determine a top of pump stroke indication; and determining on the processor a time t1 between the pump at the top of the pump stroke and the bottom of the down stroke.

10. The method of claim 9, wherein the first half of a pump cycle is a down stroke, the method further determining a time t2 between the pump at the bottom of the pump stroke and the top of the down or descending stroke, wherein this is the second half of a pump cycle, the up or ascending stroke;

comparing on the processor t1 to t2; and when t1 is greater than t2, indicating that belt slippage is occurring and transmitting a belt slippage indicator to a surface controller so that the controller can adjust a pump counterweight to reduce belt slippage.

* * * * *